United States Patent [19]

Reumann et al.

[11] Patent Number: 4,995,251

[45] Date of Patent: Feb. 26, 1991

[54] SYSTEM FOR TRIMMING LEADING AND TRAILING ENDS FROM A WIRE COIL

[75] Inventors: Manfred Reumann, Neu-Wulmstorf; Wolfgang Preiss, Buxtehude-Eilendorf; Andreas Kubicek, Hamelworden, all of Fed. Rep. of Germany

[73] Assignees: Hamburger Stahlwerke GmbH; Schwerdtfeger & Kubicek Systemtechnik GmbH & Co. KG, both of Hamburg, Fed. Rep. of Germany

[21] Appl. No.: 505,673

[22] Filed: Apr. 5, 1990

[30] Foreign Application Priority Data

Apr. 26, 1989 [DE] Fed. Rep. of Germany ..... 3913695
Jun. 17, 1989 [DE] Fed. Rep. of Germany ..... 3919836

[51] Int. Cl.[5] ..... B21F 11/00; B21B 41/10; B26D 7/00

[52] U.S. Cl. ..... 72/132; 72/203; 83/18; 83/175; 83/907; 140/2

[58] Field of Search ..... 72/66, 129, 131, 132, 72/201, 203; 83/18, 175, 262, 907, 950; 140/2; 148/12 B; 242/79, 80, 81; 266/106

[56] References Cited

U.S. PATENT DOCUMENTS

| | | | |
|---|---|---|---|
| 3,056,433 | 10/1962 | Haugwitz | 140/2 |
| 3,231,432 | 7/1966 | McLean et al. | 148/12 R |
| 3,585,887 | 6/1971 | Gerhard et al. | 83/18 |
| 3,756,289 | 9/1973 | Rotert et al. | 140/2 |
| 3,759,125 | 9/1973 | Vortkamp | 140/2 X |
| 4,064,916 | 12/1977 | Dahmen | 140/2 |
| 4,088,160 | 5/1978 | Balmat et al. | 140/2 |
| 4,498,505 | 2/1985 | Kamping et al. | 140/2 |

FOREIGN PATENT DOCUMENTS

| | | | |
|---|---|---|---|
| 1214635 | 4/1966 | Fed. Rep. of Germany | 140/2 |
| 58-195202 | 11/1983 | Japan . | |
| 60-87923 | 10/1985 | Japan . | |
| 1246049 | 9/1971 | United Kingdom | 140/2 |

*Primary Examiner*—E. Michael Combs
*Attorney, Agent, or Firm*—Herbert Dubno; Andrew Wilford

[57] ABSTRACT

The instant invention is an improvement on a method of making wire coils comprising the steps of rolling a length of wire having a leading end and a trailing end and displacing the wire in a longitudinal travel direction and coiling the wire into succeeding overlapping loops and depositing same onto an upstream conveyor. The loops are transferred from the upstream conveyor to a downstream conveyor and are deposited from the downstream conveyor onto a centering device to form a coil thereon. The downstream conveyor is driven to move the loops at a generally constant slow transport speed but the upstream conveyor is driven to move the loops at a substantially faster transport speed when loops of a portion of the wire having one of the ends are being deposited on the upstream conveyor. Otherwise the upstream conveyor is driven at the same slow speed as the downstream conveyor so that the loops of the end portion will be spaced more in the travel direction than the other loops of the wire. The wire is cut through at the end portion on the downstream conveyor and end-portion loops including the one end of the wire are removed from the downstream conveyor.

6 Claims, 1 Drawing Sheet

W
2
1
3
4
5
$V_S$ / $V_F$
10
M
11
M
12
controller
6
D
$V_S$
13
13
7
8

W
2
1
3
4
5
6
9
7
8
D

SYSTEM FOR TRIMMING LEADING AND TRAILING ENDS FROM A WIRE COIL

FIELD OF THE INVENTION

The present invention relates to the manufacture of wire in coils. More particularly this invention concerns a method of and apparatus for trimming the leading and trailing ends of a run of wire wound into a coil.

BACKGROUND OF THE INVENTION

Wire is typically produced in a rolling mill where, after leaving the furthest downstream roll stand, the wire is coiled into loops that are laid one behind the other on a conveyor. As they move downstream on the conveyor the wire is typically air-cooled (see U.S. Pat. No. 3,231,432) and at the end of this conveyor the loops are dropped onto a centering pin that forms a coil that can be bundled up and taken off for distribution.

More particularly the wire exits from the rolling line and passes first through a water-spray unit that effects an initial tempering/cooling operation. Then the wire is fed to a coiler which forms it into loops which it deposits on a short 1m to 2m long roller-type conveyor that in turn passes the succeeding overlapping loops to a much longer chain-type downstream conveyor. Blowers adjacent the downstream conveyor finish off the cooling. The roller-type upstream conveyor has very closely spaced rollers so that as the wire loops are dropped they cannot get caught; instead they will lie flat. The downstream conveyor is of the open chain type so that air can blow through it onto the loops, but since the loops are already recumbent when delivered by the roller conveyor to it there is no possibility of them catching on it.

Invariably the leading end and trailing end of a piece of wire produced in this manner are not up to tolerance. This is in part due to the fact that the length of wire cannot be fed properly at these leading and trailing ends, that the normally provided water cooling is not effective in the desired manner for the leading end piece, and due to other causes. In any case it is necessary that these off-tolerance pieces be cut off and disposed of; they cannot be left on the finished coil.

The simplest way of doing this is simply to station a worker with a bolt cutter who snips off the first 20m to 30m of wire of each run, and another such piece at the end. Clearly this procedure is inexact and costly. Furthermore the wire is typically advancing at such a rate that this type of manual procedure is fairly difficult.

In another known system such as described in Japanese patent documents 58-195202 and 60-87923 an automatic cutting device is provided at the downstream conveyor for snipping one of the loops somewhat downstream of the leading end of the run and somewhat upstream from the trailing end of the run. Then it picks off a group of the loops upstream or downstream, depending on where the cut is made.

Such a system does not work well in a high-speed rolling operation because the individual turns or loops of wire frequently shift somewhat forward or backward. Thus a loop may shift upstream so that it actually lies upstream of a loop formed of wire that is upstream of it, and similarly a loop can shift downstream so that it is slightly downstream of wire that actually is from a further downstream portion. In this case the cutting-/removing machine will snag the entire run and frequently pull a whole portion of the coil being made off the conveyor, making a serious mess and forcing the entire machine to be shut down.

OBJECTS OF THE INVENTION

It is therefore an object of the present invention to provide an improved system for trimming leading and trailing ends from a wire being coiled.

Another object is the provision of such a improved system for trimming leading and trailing ends from a wire being coiled which overcomes the above-given disadvantages, that is which automatically and accurately trims off these ends even in a high-speed wire-rolling operation.

SUMMARY OF THE INVENTION

The instant invention is an improvement on a method of making wire coils comprising the steps of rolling a length of wire having a leading end and a trailing end and displacing the wire in a longitudinal travel direction and coiling the wire into succeeding overlapping loops and depositing same onto an upstream conveyor. The loops are transferred from the upstream conveyor to a downstream conveyor and are deposited from the downstream conveyor onto a centering device to form a coil thereon. According to this invention the downstream conveyor is driven to move the loops at a generally constant slow transport speed but the upstream conveyor is driven to move the loops at a substantially faster transport speed when loops of a portion of the wire having one of the ends are being deposited on the upstream conveyor. Otherwise the upstream conveyor is driven at the same slow speed as the downstream conveyor so that the loops of the end portion will be spaced more in the travel direction than the other loops of the wire. The wire is cut through at the end portion on the downstream conveyor and end-portion loops including the one end of the wire are removed from the downstream conveyor.

Thus with this arrangement the loops are spread out in the region where they are to be cut and some are to be separated from the wire. This cutting and separation can be done manually or automatically, but there is no danger of cutting a loop that is actually upstream or downstream of where it should be, since the loops will be spaced so far apart in the travel direction that there is no possibility of such an accident occurring.

According to another feature of this invention the upstream drive is driven at the fast speed for both the leading-and trailing-end portions. The wire is cut through at both end portions, and loops including the respective ends are removed from both end portions The fast speed is selected in accordance with the type of wire.

Furthermore in accordance with this invention the one end is the leading end and the upstream drive is only operated at the fast speed until the loop including the leading end arrives at the upstream end of the downstream conveyor. Then it is slowed to the slow speed. When the one end is the trailing end there is some bunching up of the loops downstream of the cutting location but this is no problem and in no way interfere either with cutting the wire or cooling it.

The upstream conveyor according to the invention is relatively short and the downstream conveyor is relatively long. In addition the upstream conveyor is a roller conveyor.

DESCRIPTION OF THE DRAWING

The above and other objects, features, and advantages will become more readily apparent from the following, reference being made to the accompanying drawing in which.

SPECIFIC DESCRIPTION

Figure 1:
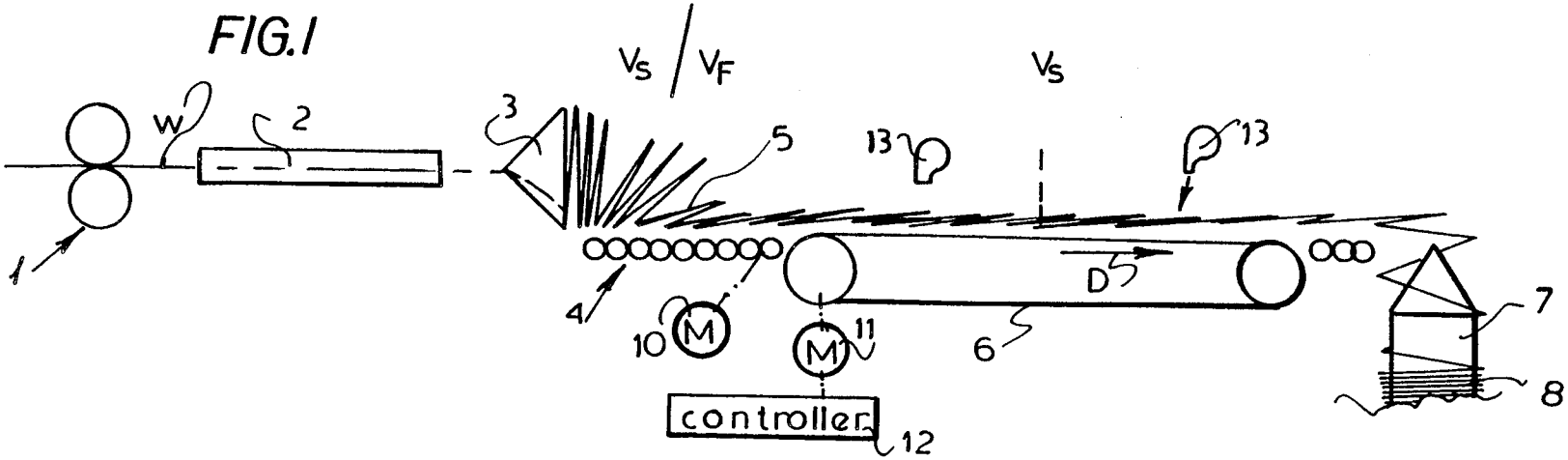
FIG. 1 is a largely schematic side view of a wire-making system according to this invention.
Figure 2:
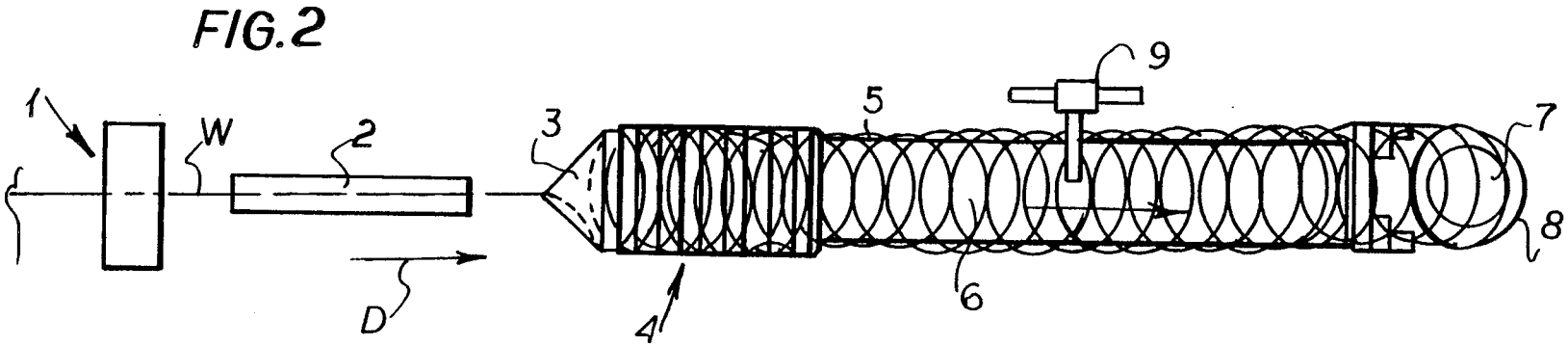
FIG. 2 is a top view of the system of FIG. 1.

As seen in FIGS. 1 and 2 a wire W is produced in a rolling mill whose last roll stand is illustrated at 1. It passes in a transport direction D through a water-cooling/tempering unit 2 and then into a coiler 3 that forms loops 5 that are deposited onto a short upstream roller conveyor 4 powered by a drive 10. From the roller conveyor 4 the loops 5 are passed to a long chain-type conveyor 6 powered by a respective drive motor 11. Normally blowers 13 are associated with the conveyor 6 to further cool and temper the wire W forming the loops 5. At the downstream end of the conveyor 6 the loops 5 are dropped onto a collecting pin 7 to form a coil 8.

According to the invention the two separate drives 10 and 11 are operated by a computer-type controller 12 and the main conveyor 6 is provided with an automatic cutting/removing device 9 that is connected to the controller 12 and that is of the type described in the above-cited Japanese patent documents. During normal operation the system of this invention operates like the prior-art systems in that the conveyors 4 and 6 both operate at the same displacement speed $V_S$. In accordance with this invention, however, the conveyor 6 is always operated at this speed $V_S$, but the upstream conveyor can be switched to a much higher speed $V_F$.

Thus at the start of a run the conveyor 4 is operated briefly at this higher speed $V_F$ so that the loops 5 deposited thereon are relatively widely spaced. It is operated at this speed until the first loop 5 comes to the upstream end of the downstream conveyor 6, then it is switched back to the slower speed $V_S$. This ensures that the loops 5 of the leading section of wire W will be relatively widely spaced, with no possibility of a downstream loop shifting upstream of an upstream loop or vice versa, so that the device 9 can operate perfectly to cut through the wire W and remove the off-tolerance sections. Nonetheless as the loops 5 are transferred, the same-speed displacement of the conveyors 4 and 6 ensure that this will take place smoothly.

Similarly at the end of the run the conveyor 4 is speeded up again so that the last loops will be similarly widely spaced apart. This will, admittedly, cause some bunching up of the loops on the conveyor 6, but such bunching will be downstream of the section to be cut off so it will have no deleterious effect on the wire W.

We claim:

1. In a method of making wire coils comprising the steps of:

rolling a length of wire having a leading end and a trailing end and displacing the wire in a longitudinal travel direction;

coiling the wire into succeeding overlapping loops and depositing same onto an upstream conveyor;

transferring the loops from the upstream conveyor to a downstream conveyor; and depositing the loops from the downstream conveyor onto a centering device to form a coil thereon, the improvement comprising the steps of:

driving the downstream conveyor to move the loops at a generally constant slow transport speed;

driving the upstream conveyor to move the loops at a substantially faster transport speed when loops of a portion of the wire having one of the ends are being deposited on the upstream conveyor but otherwise driving the upstream conveyor at the same slow speed as the downstream conveyor, whereby the loops of the end portion will be spaced more in the travel direction than the other loops of the wire; and cutting through the wire at the end portion on the downstream conveyor and removing from the downstream conveyor end-portion loops including the one end of the wire.

2. The wire-making method defined in claim 1 wherein the upstream drive is driven at the fast speed for both the leading- and trailing-end portions, the wire is cut through at both end portions, and loops including the respective ends are removed from both end portions.

3. The wire-making method defined in claim 1 wherein the one end is the leading end and the upstream drive is only operated at the fast speed until the loop including the leading end arrives at the upstream end of the downstream conveyor, then it is slowed to the slow speed.

4. An apparatus for treating and forming a length of wire into a coil, the apparatus comprising:

means including at least one roll stand for rolling a length of wire having a leading end and a trailing end and displacing the wire in a longitudinal travel direction;

an upstream conveyor;

means for coiling the wire into succeeding overlapping loops and depositing same onto the upstream conveyor;

a downstream conveyor immediately downstream of the upstream conveyor, whereby the loops are transferred from the upstream conveyor to the downstream conveyor;

a centering device at a downstream end of the downstream conveyor;

drive means for operating the downstream conveyor to move the loops at a generally constant slow transport speed, whereby the loops are deposited by the downstream conveyor thereon to form a coil thereon;

drive means for operating the upstream conveyor to move the loops at a substantially faster transport speed when loops of a portion of the wire having one of the ends are being deposited on the upstream conveyor but otherwise driving the upstream conveyor at the same slow speed as the downstream conveyor, whereby the loops of the end portion will be spaced more in the travel direction than the other loops of the wire; and means for cutting through the wire at the end portion on the downstream conveyor and for removing from the downstream conveyor end-portion loops including the one end of the wire.

5. The wire-making apparatus defined in claim 4 wherein the upstream conveyor is relatively short and the downstream conveyor is relatively long.

6. The wire-making apparatus defined in claim 4 wherein the upstream conveyor is a roller conveyor.

* * * * *